United States Patent [19]

Cortez

[11] 4,045,875

[45] Sept. 6, 1977

[54] ELLIPSOGRAPH DRAFTING APPARATUS

[76] Inventor: Raul Chajon Cortez, 2046 S. Elizabeth, Apt. 1602, Wichita, Kans. 67213

[21] Appl. No.: 668,268

[22] Filed: Mar. 18, 1976

[51] Int. Cl.[2] ..... B43L 11/04

[52] U.S. Cl. ..... 33/30 D; 33/30 R

[58] Field of Search ..... 33/30 R, 30 C, 30 B, 33/30 D, 30 F, 6, 27 R, 27 K

[56] References Cited

U.S. PATENT DOCUMENTS

| | | | |
|---|---|---|---|
| 828,372 | 8/1906 | Becker | 33/30 C |
| 1,007,910 | 11/1911 | Baker | 33/30 C |
| 3,026,617 | 3/1962 | Jendrisak | 33/27 K |

FOREIGN PATENT DOCUMENTS

| | | | |
|---|---|---|---|
| 147,323 | 5/1961 | U.S.S.R. | 33/31 |

*Primary Examiner*—Richard E. Aegerter
*Assistant Examiner*—John W. Shepperd
*Attorney, Agent, or Firm*—Phillip A. Rein

[57] ABSTRACT

This invention is an ellipsograph drafting apparatus operable to draw ellipses of any desired ratio of major and minor axes limited only by practical size of the device. The ellipsograph drafting apparatus includes a main support means, an elliptical control means, and an intermediate connector means connecting the elliptical control means to the main support means. The elliptical control means includes a marking instrument and actuator assembly which is operable to draw ellipses on a support surface through preselected movement of a pivot arm and slide assembly in a three dimensional manner.

15 Claims, 21 Drawing Figures

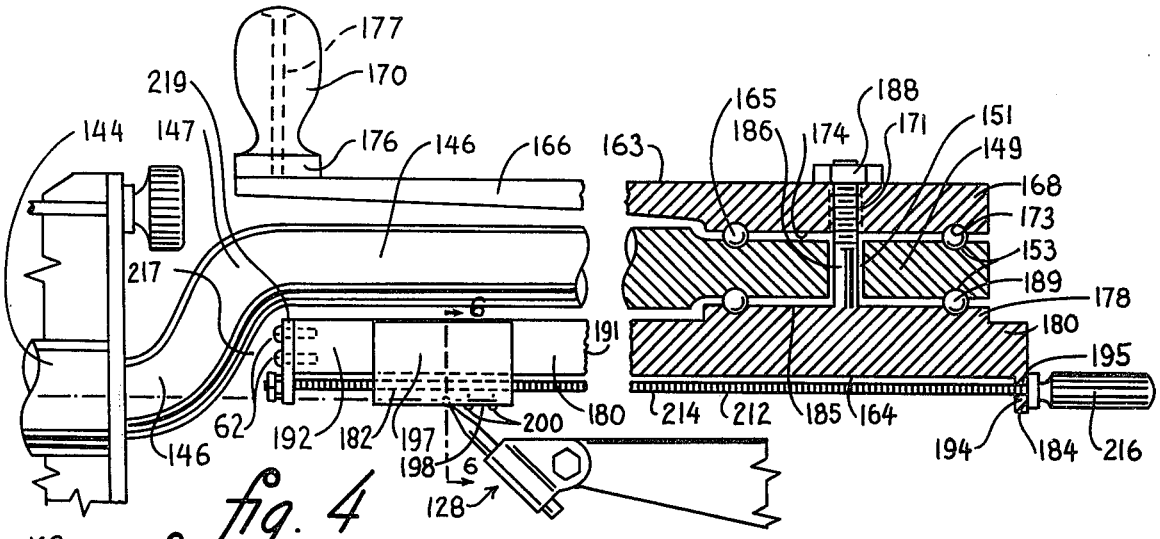
fig. 4
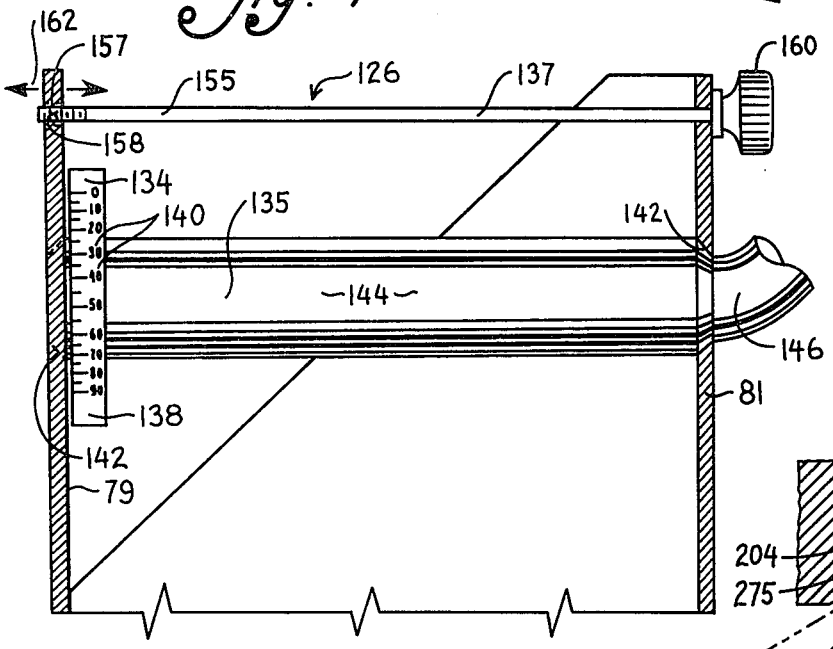
fig. 5
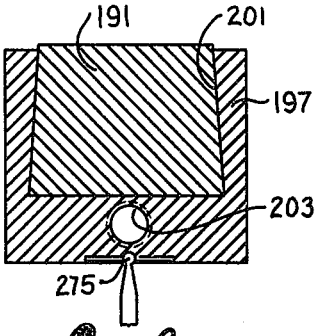
fig. 6
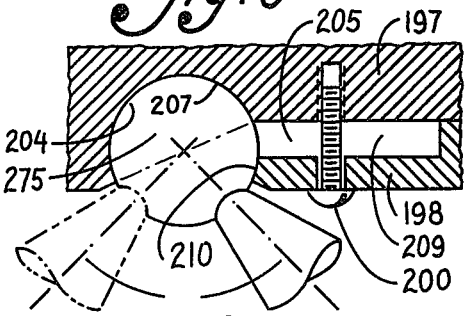
fig. 7
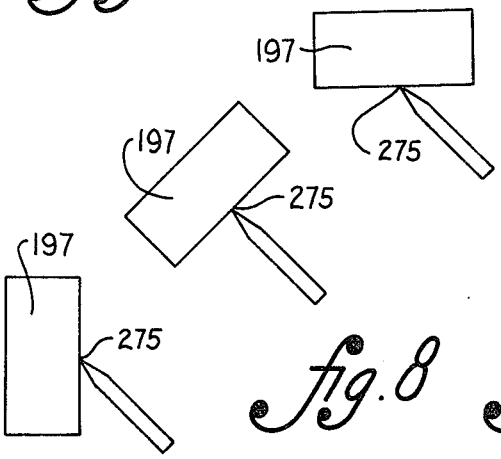
fig. 8
fig. 9
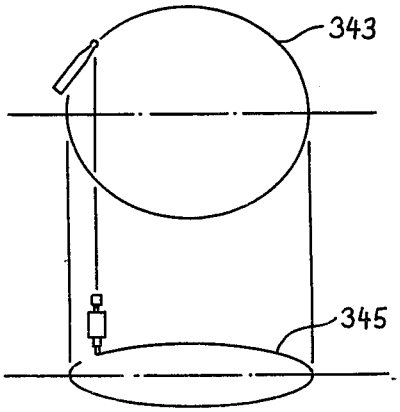

ELLIPSOGRAPH DRAFTING APPARATUS

PRIOR ART

Various types of ellipsographs are known in the prior art but such structures are not accurate and many are complicated in nature thus being expensive to manufacture. Many of the prior art devices require numerous calculations before using and are not able to accurately repeat a desired ellipse with a minimum amount of effort.

In one preferred embodiment of this invention, an ellipsograph drafting apparatus is provided including (1) a main support means; (2) an elliptical control means; and (3) an intermediate connector means. The main support means includes (1) a base support assembly; and (2) a control support assembly and an intermediate support assembly, both connected to the base support assembly. The elliptical control means includes a protractor control assembly rotatably mounted on the control support assembly; a slide and crank arm assembly secured to the protractor control assembly; a pivot arm and slide assembly connected to the slide and crank arm assembly; and a marking instrument and actuator assembly moved through interconnection of the pivot arm and slide assembly and the intermediate connector means. The protractor control assembly includes a main actuator shaft that is rotatable 90 degrees to select a minor axis of ellipse to be drawn. The slide and crank arm assembly is secured to the main actuator shaft and includes a rotatable slide assembly having a slide member with a block member adjustably mounted thereon. The block member is selectively positioned and rotated about a central axis to follow a circular path in an inclined plane to draw an ellipse. This movement or rather a vertical projection thereof is transmitted into an elliptical path on a horizontal support surface through the marking instrument and actuator assembly. The intermediate connector means is connected to the marking instrument and actuator assembly which, in turn, has a marking member to transmit the projection of movement of a point on the block member in space onto the horizontal support surface to draw an ellipse on marking paper or the like.

OBJECTS OF THE INVENTION

One object of this invention is to provide an ellipsograph drafting apparatus that is readily adjusted to draw a preselected ellipse without prior calculations being required.

Another object of this invention is to provide an ellipsograph drafting apparatus having only two adjustments for drawing an ellipse with preselected minor and major axes.

One further object of this invention is to provide an ellipsograph drafting apparatus having means to translate circular paths drawn in planes intersecting a horizontal plane onto a horizontal surface and able to draw ellipses of all sizes found between a straight line to a circle.

Still, another object is to provide an ellipsograph drafting apparatus that is simple in construction, economical to manufacture, easily adjusted, and rigidly built for long life.

Various other objects, advantages, and features of the invention will become apparent to those skilled in the art from the following discussion, taken in conjunction with the accompanying drawings, in which:

FIG. 4 is a fragmentary and sectional elevational view of an elliptical control means of the ellipsograph drafting apparatus of this invention;

FIG. 5 is an enlarged, fragmentary sectional view taken along line 5—5 in FIG. 2;

FIG. 6 is an enlarged sectional view taken along line 6—6 in FIG. 4;

FIG. 7 is an enlarged fragmentary sectional view of a slide and connector block assembly of the ellipsograph drafting apparatus of this invention;

FIG. 8 is a schematic view of the movement of the slide and connector block assembly shown in FIG. 7;

FIG. 9 is a schematic view showing transmittal of a stylus movement in planes intersecting a horizontal plane to a marking member drawing an ellipse on the horizontal support surface;

Figures 14, 15, 16:
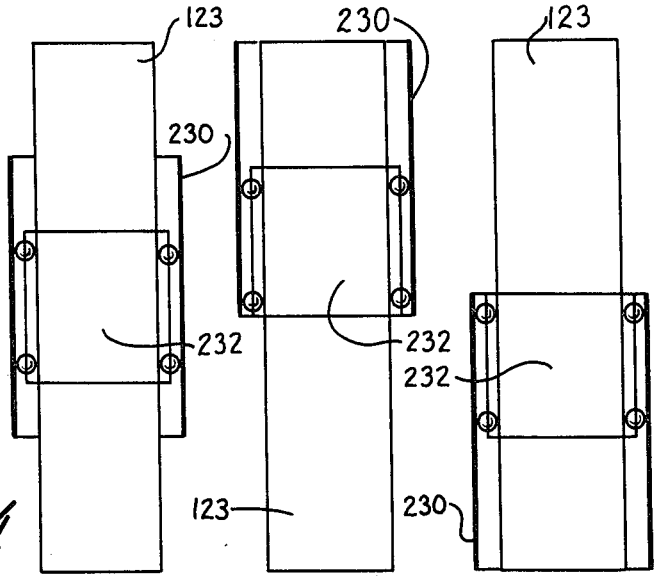
Figure 17:
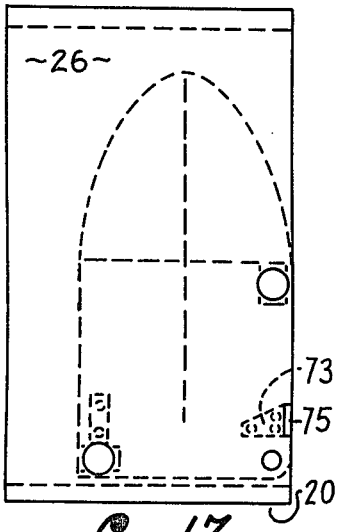
Figure 18:
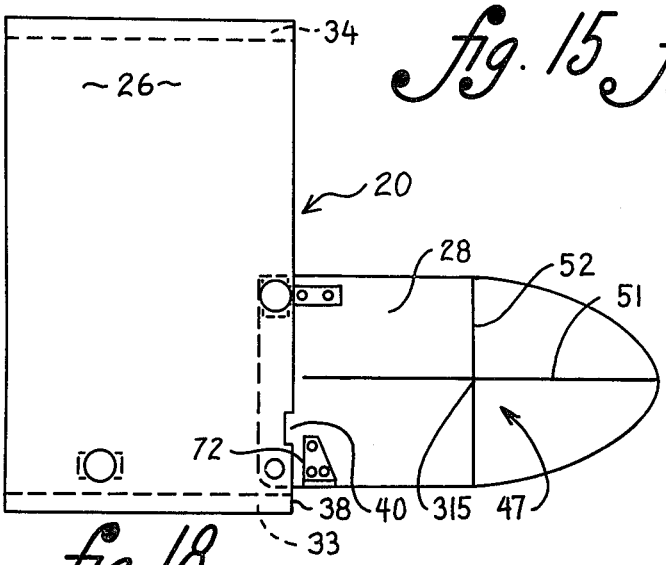
Figure 19:
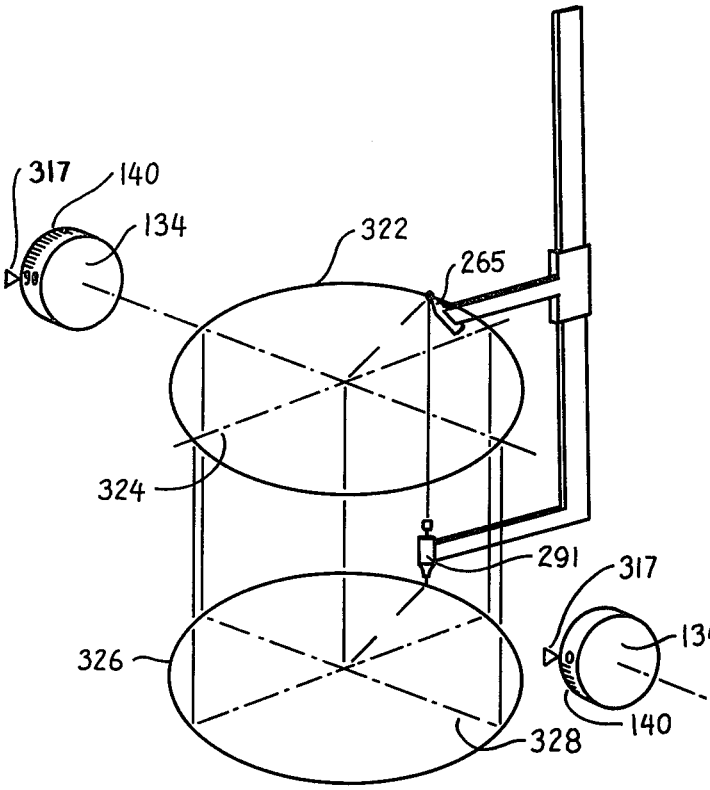
Figure 20:
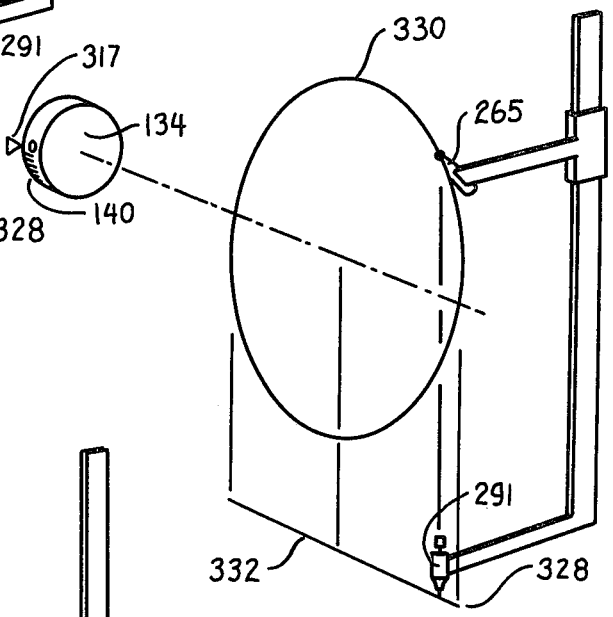
Figure 21:
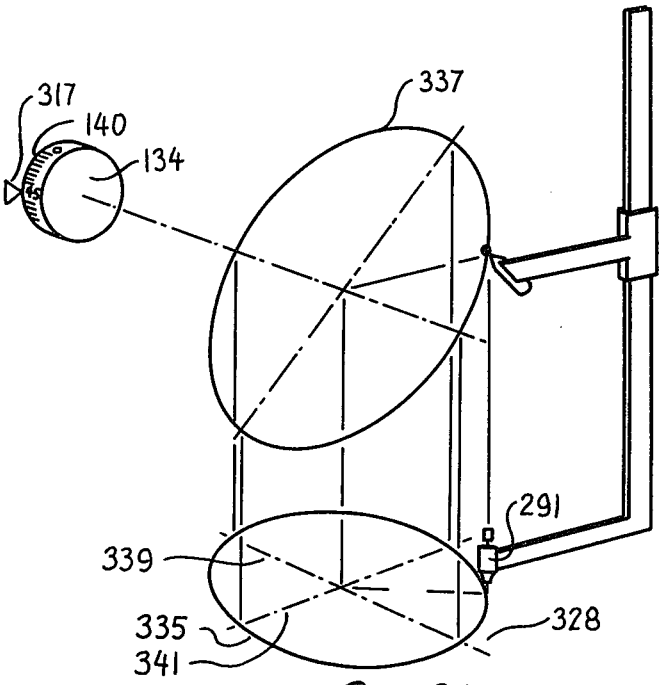

FIGS. 14, 15, and 16 are schematic views showing vertical movement of a pivot arm and slide assembly of the ellipsograph drafting apparatus of this invention;

FIGS. 17 and 18 are schematic views of a base support assembly illustrating a marking board member moved from a storage position to a usage position; and FIGS. 19, 20, and 21 are schematic views showing operation of the ellipsograph drafting apparatus of this invention used to draw a circle, a straight line, and an ellipse.

DESCRIPTION OF THE INVENTION

The following is a discussion and description of preferred specific embodiments of the new ellipsograph drafting apparatus of this invention, such being made with reference to the drawings, whereupon the same reference numerals are used to indicate the same or similar parts and/or structure. It is to be understood that such discussion and description is not to unduly limit the scope of the invention.

Figure 1:
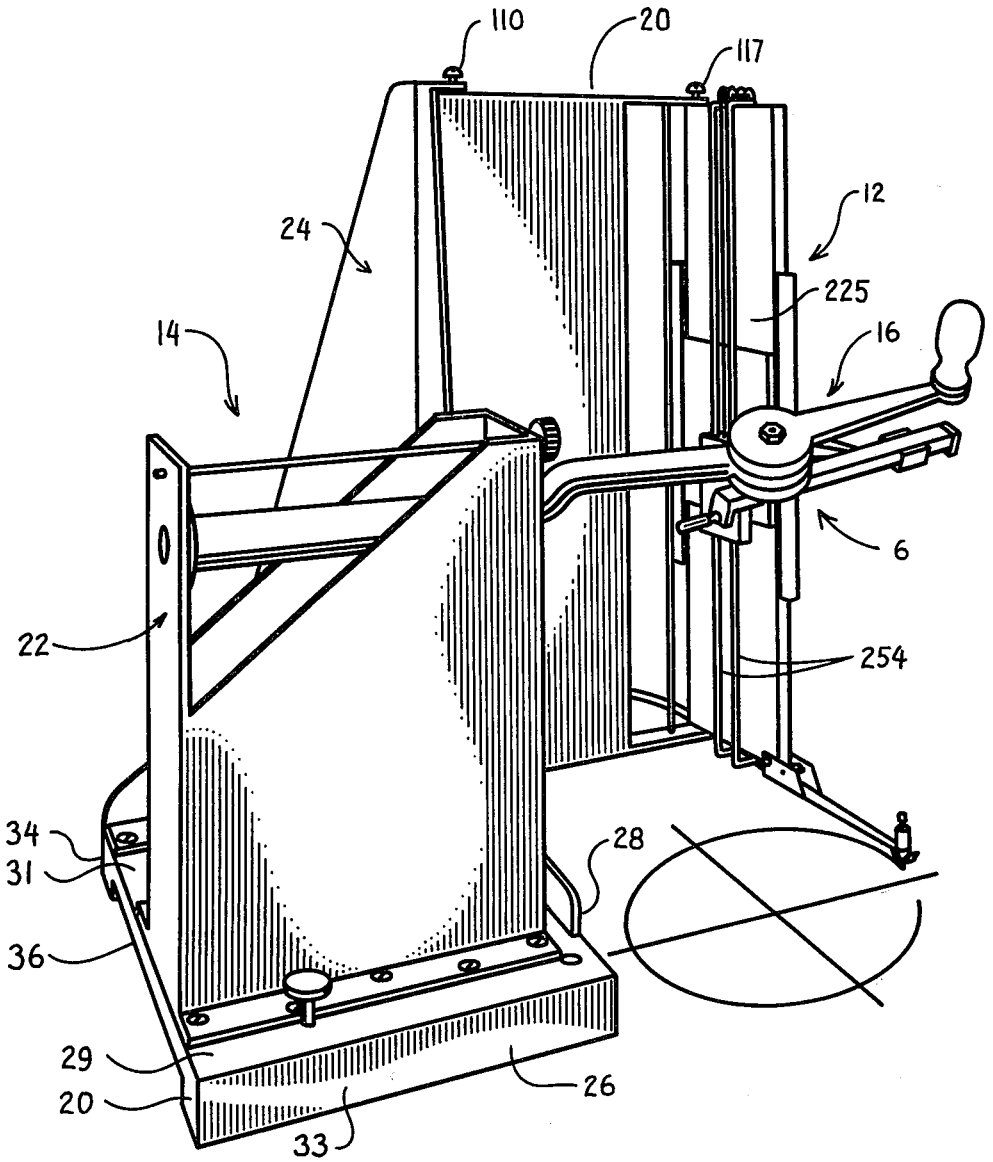
FIG. 1 is perspective view of an ellipsograph drafting apparatus of this invention shown as drawing an ellipse on a horizontal support surface.
Figure 2:
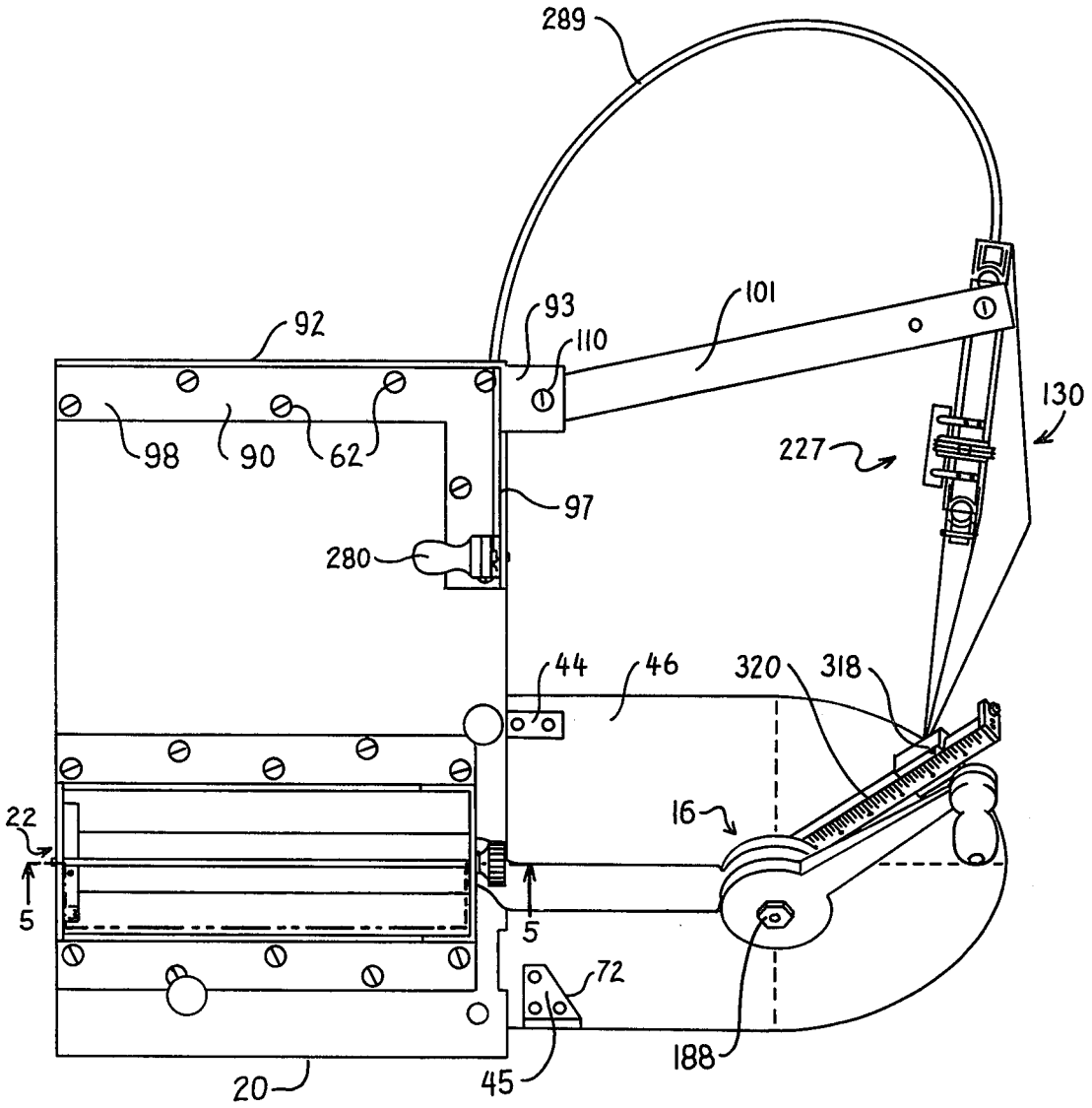
FIG. 2 is a top plan view of the ellipsograph drafting apparatus of this invention.
Figure 3:
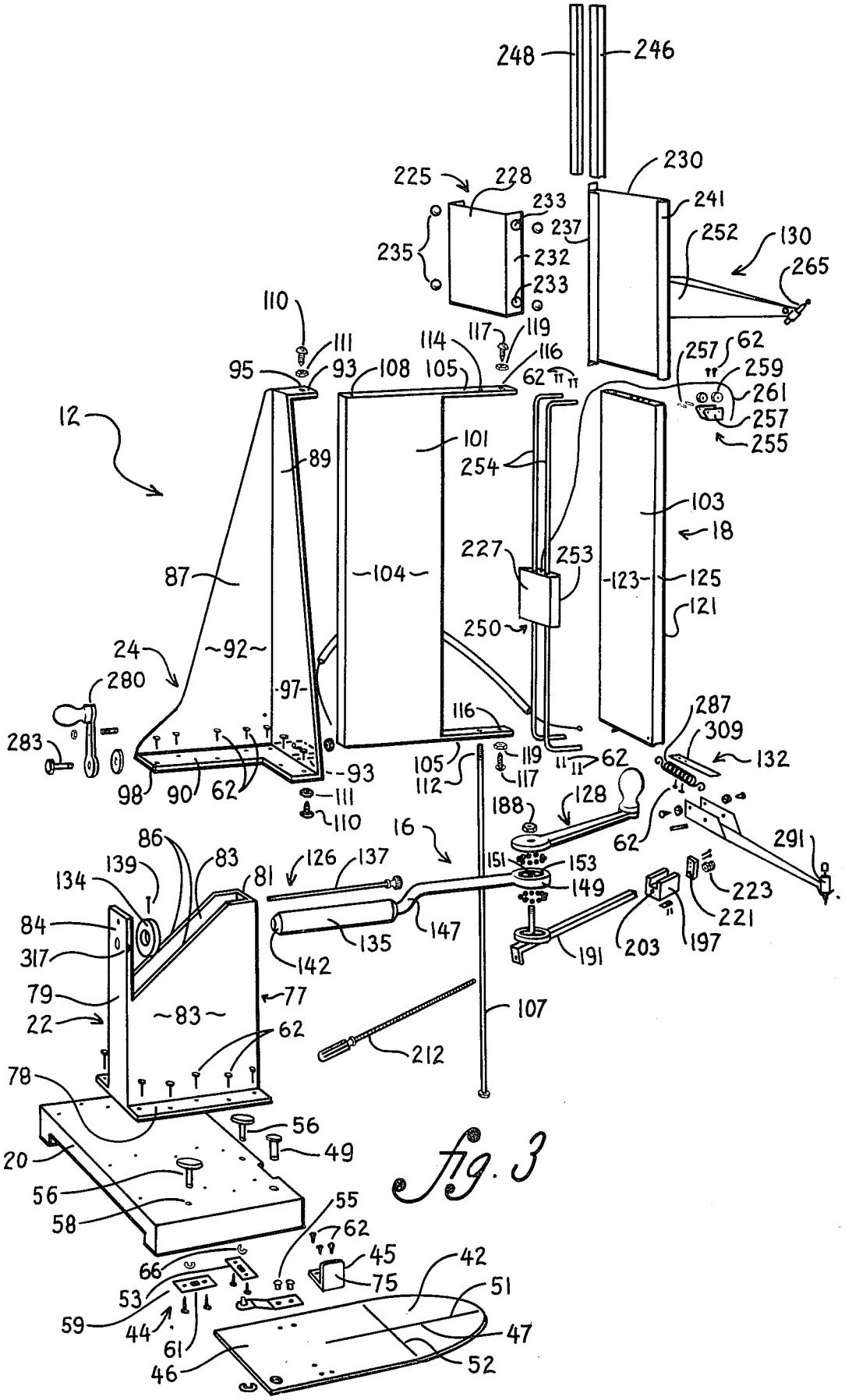
FIG. 3 is an exploded perspective view of the ellipsograph drafting apparatus of this invention.

In one preferred embodiment of this invention, an ellipsograph drafting apparatus, as best shown in FIGS. 1 and 3, is generally indicated at 12 and includes a main support means 14; an elliptical control means 16; and an intermediate connector means 18. The main support means 14 includes a base support assembly 20; a control support assembly 22; and an intermediate support assembly 24.

As shown in FIGS. 3, 17, and 18, the base support assembly 20 includes a support block member 26 having a marking board assembly 28 connected thereto. The support block member 26 has a main support body 29 with a top wall 31; parallel, downwardly depending support legs 33, 34; and an indented bottom wall 36. An inner edge 38 of the main support body 29 is provided with a cut-out section 40 for reasons to be explained. The indented bottom wall 36 is adpated to receive the marking board assembly 28 adjacent thereto in a storage position.

The marking board assembly 28 includes (1) a marking board member 42 constructed of transparent plastic; (2) a pair of releasable latch assemblies 44; and (3) a handle member 45. The marking board member 42 includes a plate member 46 of generally bullet shape having axis indicia 47 thereon. The plate member 46 is pivotally connected to a forward corner of the support body 29 by a pin member 49 and is adapted to move from the dotted line shown in FIG. 17 being the storage position to the usage position as shown in FIG. 18. It is seen that the axis indicia 47 consists of two lines 51, 52 which are perpendicular to each other and designated as X and Y axes. The X axis 51 is the major axis and the Y axis 52 is the minor axis of any ellipse drawn by the ellipsograph drafting apparatus 12 of this invention.

Figure 13:
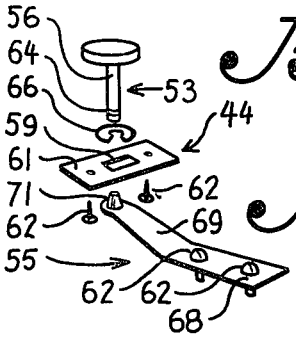
FIG. 13 is an exploded view of a releasable latch assembly of a base support assembly of the ellipsograph drafting apparatus of this invention.

Each releasable latch assembly 44 includes a release assembly 53 selectively connectable to a latch assembly 55. The release assembly 53, as best shown in FIGS. 3 and 13, includes an axially movable knob member 56 movable through a hole 58 in the main support body 29 and a hole 59 in a lock plate 61. The lock plate 61 is secured by a couple of screw members 62 of the bottom wall 36 of the main support body 29. The knob member 56 has a groove 64 about its lower end to receive a retaining or snap ring 66 thereabout.

The latch assembly 55 includes a main latch member 58 secured to the marking board member 42 by a pair of connector members being screw members 62. The latch member 68 includes an inclined body section 69 having a lock pin 71 at one end thereof. The lock pin 71 is adapted to be fit within the slot or hole 59 of the respective lock plates 61. The knob member 56 is depressed against a spring bias of the latch member 68 to contact and release the lock pin 71 from the confines of the hole 59 thereby permitting the marking board member 42 to pivot about the pin member 49 to the usage condition as shown in FIG. 18. The inclined body section 69 is biased upwardly and automatically locks in respective holes 59 in the lock plates 61 to hold in the storage and usage positions until released by respective ones of the knob members 56.

The handle member 45 is an L-shaped plate member 72 secured to the marking board member 42 by a plurality, namely three, connector members or screw members 62. The plate member 72 has a connector portion 73 secured against the marking board member 42 and, perpendicularly extending therefrom, an actuator portion 75. The actuator portion 75 is adapted to fit within the cut-out section 40 when in the storage position of FIG. 17. The actuator portion 75 is to be grasped by one's fingers when moving the marking board member 42 to the usage condition as shown in FIG. 18.

The control support assembly 22 includes a main control support member 77 of rectangular box shape having its lower end secured as by welding to a rectangular shaped base plate 78 which, in turn, is secured to the support block member 26 by a plurality of screw members 62. The control support member 77 is provided with upright opposed sidewalls 79, 81 interconnected by sidewalls 83. The outer endwall 79 is provided with an upper flexible portion 84 which is achieved through tappered edges 86 of the parallel sidewalls 83 to allow for adjustment and clamping action as will be explained.

The intermediate support assembly 24 includes first and second support plates 87 and 89 interconnected at a lower edge by an angle iron member 90. The second support plate 89 has a main body portion 97 with upper and lower laterally extended, parallel connector tabs 93, each having a hole 95 therein for reasons to be explained. The first support plate 87 has a main body section 92 of irregular shape and operates to provide rigidity to the second support plate 89. The angle iron member 90 is provided with a plurality of holes 98 therein to receive respective screw members 62 for anchoring to the upper surface of the support block member 26.

The intermediate connector means 18 includes a linkage assembly 101 connected to a marking arm support assembly 103. The linkage assembly 101 includes a vertical support plate 104 having laterally extended parallel support arms 105 and a connector rod 107 associated therewith. The vertical support plate 104 has axially aligned, upper and lower holes 108 to receive respective bolt members 110 and a lock nut 111 for connection to the connector tabs 93 of the second support plate 89 to allow pivotal movement about a vertical axis. The parallel support arms 105 are interconnected as by the connector rod 107 having a threaded end 112 thereon to be mounted within a threaded hole 114 in the upper support arm 105. The support arm 105 is provided with axially aligned threaded openings 116 to receive a bolt member 117 and lock nut 119 for pivotal connection to the marking arm support assembly 103.

The marking arm support assembly 103 includes a base support member 121 connected by the bolt members 117 to the support arms 105 thus allowing pivotal movement about a vertical axis. The base support member 121 includes a rectangular shaped body member 123 having parallel outer vertical endwalls 125. The vertical endwalls 125 are of a semi-circular groove configuration in transverse cross section (See FIG. 10).

The elliptical control means 16 includes (1) a protractor control assembly 126; (2) a slide and crank arm assembly 128; (3) a pivot arm and slide assembly 130; and (4) a marking instrument and actuator assembly 132. The protractor control assembly 126 includes a calibrated protractor plate 134; a main actuator shaft 135; and an elongated lock shaft 137.

The protractor plate 134 includes an indicator disc 138 having angle indicia 140 thereon from 0 to 90 degrees. The indicator disc 138 is mounted about the main actuator shaft 135 and secured thereto as by a set screw 139 and mounted adjacent the outer endwall 79 of the control support assembly 22 as shown in FIG. 5.

The main actuator shaft 135 has tappered end or bevel portions 142 which are mounted within respective ones of the endwalls 79, 81 of the control support assembly 22 so as to be rotatable but secured in a given rotational position by the lock shaft 137. The main actuator shaft 135 is provided with a control section 144 of cylindrical shape integral with a connector arm section 146. The connector arm section 146 has an off-set portion 147 integral with a connector yoke portion 149. The yoke portion 149 is of a circular shape having a central hole 151 and upper and lower bearing race grooves 153 for reasons to be explained.

The lock shaft 137 includes a main body 155 having one threaded end portions 157 to be mounted within a threaded hole 158 in the endwall 79 and the opposite end portion provided with a knob section 160. It is seen by the arrow 162 that the knob section 160 is rotatable in one direction to move the endwall 79 in order to clamp the main actuator shaft 135 in a desired predetermined position. The knob section 160 is rotatable in an opposite direction to release force against the tappered end portions 142 of the main actuator shaft 135. The main actuator shaft 135 can then be rotated to a desired reading of the angle indicia 140 depending on the ellipse to be drawn.

The slide and crank arm assembly 128 includes a crank arm member 163 connected to a slide and connector block assembly 164 and mounted through a bearing assembly 165 to the yoke portion 149 of the connector arm section 146 of the main actuator shaft 135. The crank arm member 163 is provided with a connector arm 166 having one end formed with a connector disc section 168 and the other end connected to a turn knob section 170. The connector disc section 168 is of a circular shape and has a central threaded hole 171 and a bearing race portion 173 in a bottom wall 174 as shown in FIG. 4. The turn knob section 170 is provided with a conventional knob member 176 rotatable about a shaft member 177 for rotating the entire crank arm member 163 as will be described.

It is seen that the slide and connector block assembly 164 includes (1) an attachment assembly 178; (2) a slide assembly 180; (3) a connector block assembly 182; and (4) an adjustment screw assembly 184. The attachment assembly 178 includes a connector disc 185 having a central threaded connector shaft 186 mounted through the hole 151 in the yoke portion 149 and threaded into the hole 171 in the connector disc section 168 and anchored by a nut member 188. The connector disc section 168 and the connector disc 185 move conjointly about the yoke portion 149.

The bearing assembly 165 includes a plurality of ball bearing members 189 which are mounted between the connector yoke portion 149, the connector disc section 168 and connector disc 185 in the bearing race portion 173 and bearing race groove 153 to permit ease of rotation.

The slide assembly 180 includes an elongated slide member 191 of trapezoidal shape in transverse cross section (FIG. 6) and having an outer connector end section 192. As shown in FIG. 4, the slide assembly 180 can be an integral part of the connector disc section 185 and includes a downwardly, depending connector tab section 194. The connector tab section 194 has a central hole 195 therein.

The connector block or connection assembly 182 includes a block member 197 having an anchor member 198 and two bolt members 200 connected thereto. The block member 197 includes (1) a central trapezoidal groove 201 to fit about the slide member 191 for axial movement thereon; (2) an axially extended threaded hole 203; and (3) a pivot connector section 205. As shown in FIGS. 6 and 7, the connector section 205 has a semi-spheroidal portion 207 to receive a ball type pivot therein and an attachment portion 209. The anchor member 198 is mounted in the attachment portion 209 by the bolt member 200. The anchor member 198 has a curved forward edged 210 to clamp against a ball type pivot as will be explained. The block member 197 is movable on the slide member 191 to select the size of ellipses to be drawn.

The adjustment screw assembly 184 includes a screw member 212 having a threaded main body 214 and an integral handle section 216 at one end and a connector plate assembly 217. The connector plate assembly 217 includes a plate member 219 secured by screw members 62 to the outer end of the slide member 191 (FIG. 4). The plate member 219 has a hole 221 to receive the screw member 212 therein and connected to two nut members 223. The screw member 212 is mounted in the threaded hole 203 in the block member 197 so rotational movement thereof operates to move the block member 197 axially relative to the slide member 191.

Figure 10:
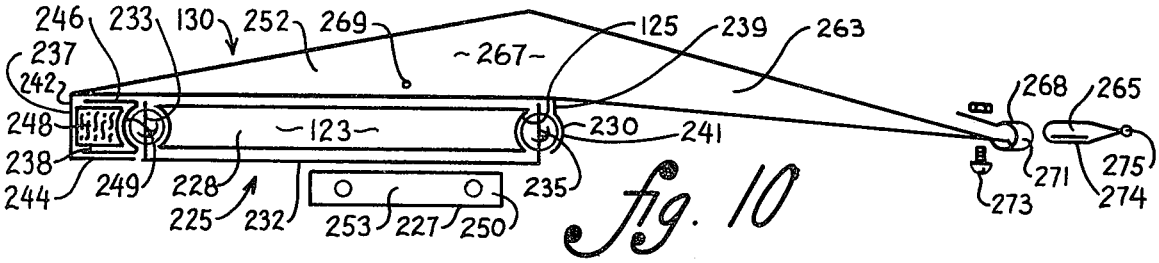
FIG. 10 is a top plan view showing an intermediate connector means of the ellipsograph drafting appartus of this invention.

As best shown in FIGS. 3 and 10, the pivot arm and slide assembly 130 includes (1) a slide bearing assembly 225 and (2) a counterbalance and pivot arm assembly 227. The slide bearing assembly 225 includes an inner bearing support assembly 228 and an outer bearing support assembly 230. The inner bearing support assembly 228 includes a bearing plate member 232 of U-shape having a plurality, namely four, spaced openings 233 to receive bearing members 235 therein. As shown in FIG. 10, the bearing plate member 232 is movable vertically and axially with the bearing members 235 contacting the endwalls 125 of the base support member 121.

The outer bearing support assembly 230 includes an outer race member 237 having a bearing connector assembly 238 mounted therein. The outer race member 237 is provided with one endwall 239 having a curved portion 241 is receive the bearing members 235 thereagainst and another endwall 242 is formed with a rectangular retainer section 244 to receive the bearing connector assembly 238. The bearing connector assembly 238 includes a bearing groove member 246 and a biasing member 248. The bearing groove member 246 has a curved portion 249 to receive the other bearing members 235 thereagainst. The biasing member 248 is constructed of rubber to bias the outer race member 237 into contact with the bearing members 235 but permitting relative axial movement of the inner support assembly 228 and the outer bearing support assembly 230 as shown in FIGS. 14, 15, and 16.

The counterbalance and pivot arm assembly 227 includes a counterbalance assembly 250 operably connected to a pivot arm assembly 252. The counterbalance assembly 227 includes a weight member 253 which is axially movable on a pair of parallel support rods 254 and connected to the base support member 121 through a pulley assembly 255. The weight member 253 is of a rectangular block type structure and may be an adjustable weight structure to provide for counterbalancing and proper movement of the slide bearing assembly 225. The support rod 254 is secured as by screw members 62 to respective upper and lower end portions of the base support member 121. The pulley assembly 255 includes (1) a pulley support body 257; (2) a pair of pulley members 259 secured as by pin members to the pulley support body 257; and (3) a connector cable 261 within one end trained about the pulley members 259 and connected to the weight member 253. It is seen that the pulley support body 257 is secured as by screw members 62 to the upper end portion of the base support member 121. The weight member 253 has central holes placed about the support rods 254 for controlled vertical, axial movement.

The pivot arm assembly 252 includes a pivot arm support 263 which is secured as by welding to the outer bearing support assembly 230 and a pivot member 265 of somewhat bottle shape connected to an outer end of the pivot arm support 263. The pivot arm support 263 includes a main body 267 having the outer end provided with a pivot connector section 268. The main body 267 is of irregular shape having a hole therein to receive the other end of the connector cable 261. The pivot connector section 268 is provided with a cylindrical clamp section 271 and a nut and bolt member 273 to secure the pivot member 265 therewithin. The pivot member 265 is provided with a main cylindrical body portion 274 to be clamped by the clamp section 271 and having an integral, outer end ball portion 275. The end ball portion 275 is of spheroidal shape as shown in FIGS. 6 and 7 adapted to be pivoted freely from 0 to 90 degrees within the block member 197 in a path defining a cone shape with a 90 degree apex.

Figure 11:
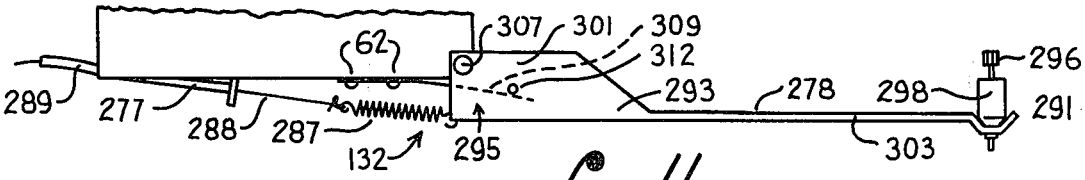
FIG. 11 is a fragmentary side elevational view of the intermediate connector means and an marking instrument and actuator assembly of the ellipsograph drafting apparatus of this invention.
Figure 12:
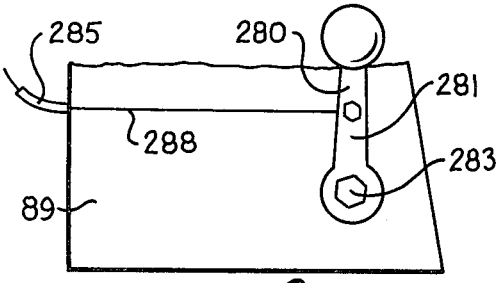
FIG. 12 is a fragmentary elevational view of a control lever and cable assembly of the marking instrument and actuator assembly of this invention.

As shown in FIGS. 11 and 12, the marking instrument and actuator assembly 132 includes an actuator assembly 277 secured to a marking instrument assembly 278. The actuator assembly 277 includes a control level and cable assembly 280. The control lever and cable assembly 280 includes a lever member 281 pivotally connected as by a bolt member 283 to a lower portion of the second support plate 89 (FIG. 12) and connected to a cable member 285 which is connected through a spring member 287 to the marking instrument assembly 278. The cable member 285 has an inner wire 288 mounted within an outer sheath portion 289. The outer sheath portion 289 is stationary but the control lever member 281 is pivotal about the bolt member 283 and, with cooperation of the spring member 287, to vary a downward biasing force on the marking instrument assembly 278 as will be explained.

The marking instrument assembly 278 includes a marking member 291 mounted on a support assembly 293 which is secured to the base support member 121 by a connector assembly 295. The marking member 291 is of a conventional stylus pen structure having a marking point member 296 mounted within a cylindrical housing 298 which holds ink therein for marking on a given support surface. The support assembly 293 is provided with a central body 301 integral with an elongated stylus support portion 303. The central body 301 is provided with a hole to receive a bolt member 307 from the connector assembly 295 to pivotally attach same to the base support member 121. The connector assembly 295 further includes (1) a leaf spring member 309 secured as by screw members 62 to the bottom surface of the base support member 121; and (2) a support shaft 312 mounted in the central body 301. The support shaft 312 contacts the leaf spring member 309 to bias the entire marking instrument assembly 278 in an upward direction. This biasing force is counterbalanced by the biasing force of the control lever and cable assembly 280 so as to achieve pressure of the marking member 291 on the paper to be marked thereon. This allows flexibility of movement of the marking member 291.

USE AND OPERATION OF THE INVENTION

On the use and operation of the ellipsograph drafting apparatus 12 of this invention, the marking board member 42 is movable from the storage condition as shown in FIG. 17 to the usable position as shown in FIG. 18 through release of the latch assembly 44 and movable outwardly by the handle member 45. This places the X and Y axes in proper perspective to indicate the major and minor axes of ellipses to be drawn. The X and Y axes intersection at an origin indicated at 315 which is the center point of any circle or ellipse to be drawn. A marking surface such as drafting paper or other materials can be placed underneath the marking board member 42 to have an ellipse drawn thereon. The force of the marking member 291 against the drafting paper can be regulated through the control lever and cable assembly 280 to pull the marking instrument assembly 278 downwardly against the force of the leaf spring member 309. The spring member 287 biases the marking instrument assembly 278 in the opposite direction so as to be flexible in both directions about the bolt member 307.

Next, the inclination of a path to be followed in space relative to horizontal is adjusted by the protractor control assembly 126. As shown in FIG. 5, the lock shaft 137 is rotated to release pressure of the endwalls 79, 81 against the bevel portion 142 of the main actuator shaft 135. The inclination is adjusted between 0° to 90° and aligned with an indicator 317 on the endwall 79 with the angle indicia 140 on the protractor plate 134.

The actual size or dimensions of the major and minor axes of the ellipse to be drawn is regulated by the slide and connector block assembly 164. The block member 197 is movable axially on the slide member 191 by rotation of the adjustment screw assembly 184. The block member 197 has a indicator 318 to be aligned with linear indicia 320 on the slide member 191. The off-set nature of the axis of the connector arm section 146 is such that when the position zero (0) on linear indicia 320 on the slide member 191, the center of the endball portion 275 is in axial alignment with the central axis of the actuator shaft 135. In this position, rotation of the crank arm member 163 would merely trace a dot by the marking member 291 on the drafting paper.

To progress from a dot to the maximum size relative to outward movement of the block member 197 on the slide member 191 is shown in FIG. 19. With the indicator 317 aligned with angle indicia 140 of 90° on the protractor plate 134, a circle indicated at 322 is traced in an upper horizontal plane 324 in space and, through the elliptical control means 16, this movement is transferred, being a circle 326 on a horizontal support surface 328. The size of the circle is only limited by length of the slide member 191 which sets the radius of the circle to be drawn.

As shown in FIG. 20, the other extreme is the drawing of a straight line when the indicator 317 is aligned with angle indicia 140 of 0° on the protractor plate 134. In this case, a circle indicated at 330 is drawn in a vertical plane and transmitted to a straight line 332 on the horizontal support surface 328. The length of the straight line 332 is determined by the position of the block member 197 on the slide member 191 being twice the distance from zero position on the linear indicia 320 on the slide member 191.

Next, as indicated in FIGS. 9 and 21, an ellipse 335 can be drawn on the horizontal support surface 328 between the extreme of a circle (FIG. 19) and a straight line (FIG. 20). In FIG. 21, the indicator 317 is aligned with angle indicia 140 of 45° on the protractor plate 134. A circle is drawn in a plane indicated at 337 which is at an angle of 45° to a horizontal plane. The vertical projection of this circle 337 is transmitted to the ellipse 335 on the horizontal support surface 328. This ellipse 335 presents major axis 339 being equal to a diameter of the circle 337 and determined by the setting of the block member 197 on the slide member 191. A minor axis 341 is determined by both the inclination setting on the protractor plate 134 and setting of block member 197 on the slide member 191.

FIG. 9 shows a similar projection of a circle 343 drawn in space that is transmitted through the linkage assembly 101 to the drawing of an ellipse 345 on drafting paper. FIGS. 7 and 8 show pivotal movement of the ball end portion 275 in the block member 197 from 0° to 90° and the clearance provided to achieve this movement.

The elliptical control means operates to easily and accurately transmit movement of the pivot member in space into its vertical projection on a horizontal plane. One can select an ellipse of a given angular inclination and major and minor axes size easily with the ellipsograph drafting apparatus of this invention. The counterbalance and pivot arm assembly allows the pivot arm assembly to move smoothly and without effort to transfer movement from the pivot member to the marking member.

It is seen that the ellipsograph drafting apparatus of this invention accurately and reliably transfers movement in space of a circle outline into its elliptical vertical projection to a horizontal plane. The ellipsograph drafting apparatus is simple in construction, easily adjustable to ellipses of various sizes, and economical to manufacture.

While the invention has been described in conjunction with preferred specific embodiments thereof, it will be understood that this description is intended to illustrate and not to limit the scope of the invention, which is defined by the following claims:

I claim:

1. An ellipsograph drafting apparatus to draw any ellipse existing within major and minor axes boundaries of a straight line to a circle on a horizontal marking surface, comprising:

a. a main support means;

b. an intermediate connector means having a linkage assembly pivotally connected to said main support means and a base support member pivotally connected to said linkage assembly for pivotal movement about a vertical axis;

c. an elliptical control means connected to said main support means and said intermediate connector means;

d. said elliptical control means having a protractor control assembly rotatable about a horizontal axis, a slide and crank arm assembly rotatably mounted to said protractor control assembly, to a pivot arm and slide assembly connected to said slide and crank arm assembly, and a marking instrument and actuator assembly connected to said base support member;

e. said pivotal arm and slide assembly mounted on said base support member for conjoint movement therewith about the vertical axis and for vertical movement relative thereto;

f. slide and crank arm assembly having a connector member pivotally connected to a pivot member of said pivot arm and slide assembly; and g. said connector member rotatable about a common central point in planes from 0° to 90° relative to a vertical axis through said central point to cause said pivot member to move identical to said connector member and transmit a vertical projection of the movement of said pivot member onto the horizontal marking surface through said marking instrument and actuator assembly.

2. An ellipsograph drafting apparatus as described in claim 1, wherein:

a. said main support means having a base support assembly;

b. said base support assembly including a support block member having a marking board assembly pivotally connected to said block member;

c. said marking board assembly having a marking board member connected by a release latch assembly to said block member; and d. said board member movable from a storage position under said block member to a usage position laterally therefrom and locked in both positions by said release latch assembly.

3. An ellipsograph drafting apparatus as described in claim 2, wherein:

a. said marking board member having axis indicia thereon;

b. said axis indicia having X and Y axes lines perpendicular to each other to define respective major and minor axes of any ellipse drawn on the horizontal marking surface; and c. said X and Y axes having a point of intersection in vertical alignment with said central point.

4. An ellipsograph drafting apparatus as described in claim 1, wherein:

a. said protractor control assembly having a protractor plate secured to a main actuator shaft which, in turn, is rotatable about said horizontal axis;

b. said protractor plate having angle indicia marking thereon from 0° to 90° to align with an indicator mounted on said main support means; and c. said slide and crank arm assembly movable conjointly with rotation of said actuator shaft for movement of said connector member in planes from 0° to 90° relative to said vertical axis.

5. An ellipsograph drafting apparatus as described in claim 4, wherein:

a. said main support means including a control support assembly having spaced end walls;

b. said actuator shaft mounted in said spaced end walls; and c. said protractor control assembly having a lock shaft mounted in said end walls operable to move one of said end walls relative to each other to selectively clamp and release said actuator shaft to adjust rotation thereof from 0° to 90° as shown on said angle indicia.

6. An ellipsograph drafting apparatus as described in claim 1, wherein:

a. said slide and crank arm assembly including a crank arm member connected to a slide and connector block assembly which, in turn, is connected through a bearing assembly to said protractor control assembly so that said crank arm member is rotatable about an off-set point relative to said horizontal axis of said protractor control assembly and a slide assembly connected to said crank arm member and rotatable thereabout;

b. said slide assembly including a slide member extended radially, outwardly from said off-set point and having a linear indicia thereon;

c. said connector member being a block member rotatable about said central point and adjustable mounted on said slide member for relative longitudinal movement; and d. said block member moved to a predetermined position on said slide member to determine the size of an ellipse to be drawn on the horizontal marking surface by said marking instrument and actuator assembly.

7. An ellipsograph drafting apparatus as described in claim 6, wherein:

a. said slide and connector block assembly having an adjustment screw assembly connected to said slide member and said block member whereby rotation of said screw assembly moves said connector block selectively axially.

8. An ellipsograph drafting apparatus as described in claim 1, wherein:

a. said main support means including a control support assembly and an intermediate support assembly;

b. said portractor control assembly rotatably mounted in said control support assembly;

c. said intermediate connector means connected to said intermediate support assembly;

d. said intermediate connector means having a linkage assembly with a vertical support plate pivotal about another vertical axis; and e. said base support member pivotal about said vertical axis and said another vertical axis.

9. An ellipsograph drafting apparatus as described in claim 8, wherein:

a. said pivot arm and slide assembly including a slide bearing assembly slidably connected to said base support member for relative vertical movement, and a pivot arm assembly connected to said slide bearing assembly; and b. said pivot arm assembly including a pivot arm support secured to said slide bearing assembly for conjoint vertical movement, and said pivot member connected to said pivot arm support and said connector member;

whereby said pivot arm moves in a vertical direction with movement of said pivot arm assembly and in X – Y paths in horizontal planes on movement of said base support member and said vertical support plate about said vertical axis and said another vertical axis.

10. An ellipsograph drafting apparatus as described in claim 9, wherein:

a. said pivot arm and slide assembly including a counterbalance assembly connected to said pivot arm assembly and said base support member; and b. said counterbalance assembly having a movable weight member connected to said pivot arm assembly to move in opposite vertical directions;

whereby said weight member counters weight of said pivot arm support to achieve easy movement thereof.

11. An ellipsograph drafting apparatus as described in claim 8, wherein:

a. said marking instrument and actuator assembly including an actuator assembly connected to said main support means, and a marking instrument assembly connected to said base support member and said actuator assembly; and b. said marking instrument having a marking member connected to a support assembly which, in turn, is pivotally connected to said base support member by a connector assembly.

12. An ellipsograph drafting apparatus as described in claim 11, wherein:

a. said actuator assembly connected to said support assembly to bias same in a downward direction; and b. said connector assembly having a bias member connected to said support assembly to bias same in an upward direction;

whereby said marking member is held in a given position whereby any movement therefrom is against the bias of either said actuator assembly or said support assembly.

13. An ellipsograph drafting apparatus as described in claim 12, wherein:

a. said connector assembly having a leaf spring member secured to said base support member and said support assembly to provide the upward bias.

14. An ellipsograph drafting apparatus as described in claim 13, wherein:

a. said actuator assembly having a control lever and cable assembly connected to said main support means and said support assembly; and b. said control lever and cable assembly having a lever member connected to a cable member to adjustably urge said support assembly in a downward direction against the bias of said leaf spring member.

15. An ellipsograph drafting apparatus as described in claim 14, wherein:

a. said actuator assembly having a spring member connected to said cable member to provide the downward bias force.

* * * * *